US006131779A

United States Patent [19]

Gendala

[11] Patent Number: 6,131,779

[45] Date of Patent: Oct. 17, 2000

[54] BOTTLE CARRIER

[76] Inventor: Christopher M. Gendala, 24 Broadway, Elwood, Australia

[21] Appl. No.: 09/284,256

[22] PCT Filed: Aug. 21, 1997

[86] PCT No.: PCT/AU97/00530

§ 371 Date: Apr. 9, 1999

§ 102(e) Date: Apr. 9, 1999

[87] PCT Pub. No.: WO98/16132

PCT Pub. Date: Apr. 23, 1998

[30] Foreign Application Priority Data

| | | | |
|---|---|---|---|
| Oct. 14, 1996 | [AU] | Australia | PO2938 |
| Nov. 1, 1996 | [AU] | Australia | PO3375 |
| May 8, 1997 | [AU] | Australia | PO6676 |

[51] Int. Cl.[7] ..... A45F 5/00

[52] U.S. Cl. ..... 224/148.1; 224/148.4; 224/148.7; 224/197; 248/312; 248/312.1

[58] Field of Search ..... 224/148.4, 148.1, 224/148.7, 197, 247; 248/312, 312.1; 211/74, 75

[56] References Cited

U.S. PATENT DOCUMENTS

| | | | |
|---|---|---|---|
| 1,969,677 | 8/1934 | Stowell . | |
| 3,192,894 | 7/1965 | Staver | 248/312 |
| 3,273,766 | 9/1966 | Cosentino . | |
| 4,909,467 | 3/1990 | Shan-Pao | 248/312 |
| 5,285,940 | 2/1994 | Goulter | 224/148.4 |
| 6,019,335 | 2/2000 | Sehati | 248/312 |

FOREIGN PATENT DOCUMENTS

| | | | |
|---|---|---|---|
| 84708/75 | 3/1977 | Australia . | |
| 360110 | 12/1905 | France | 224/247 |

*Primary Examiner*—Gregory M. Vidovich
*Assistant Examiner*—Maerema W. Brevard
*Attorney, Agent, or Firm*—Nixon & Vanderhye PC

[57] ABSTRACT

A bottle carrier (10) is shown which has a connection section (14) formed from a bent strap having portions (14*a* and 14*b*) which are connected by a curved transition (14*c*). The connection section (14) includes a rod (40). The gripping section (12) includes a pair of claws (18 and 20) which have curved ends (18*a* and 20*a*) so that the neck of a bottle (B) can be received between the claws (18 and 20). The gripping section (12) includes a sleeve (24) which clips onto the rod (40) to pivotally couple the gripping section (12) with respect to the carrier (14) so that the gripping section (12) can pivot relative to the connection section (14). The claws (18 and 20) have curved ends (18*a* and 20*a*) which contact the upper body portion of the bottle (B) so that the bottle is retained within the carrier (10) by the combined effect of a flange of the bottle resting on the claws (18 and 20) and the curved ends (18*a* and 20*a*) engaging the upper body (B') of the bottle (B). In other arrangements, the claws (18*a* and 20*a*) can be oriented so that they curve upwardly so a long necked bottle (Ba) can be retained by the claws (18 and 20) and locating lugs (28) with the bottle (Ba) having to be lifted over the upwardly curved ends (18*a* and 20*a*) in order to separate the bottle (Ba) from the carrier (10).

29 Claims, 2 Drawing Sheets

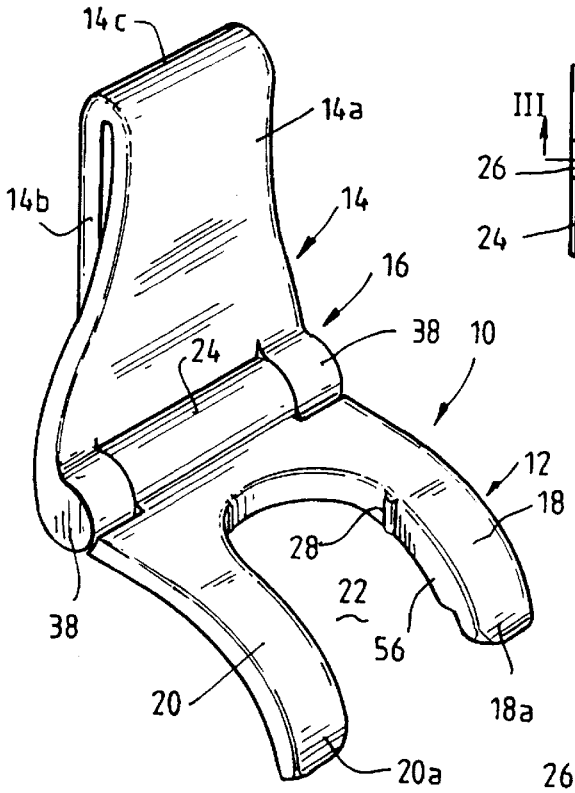
FIG. 1.
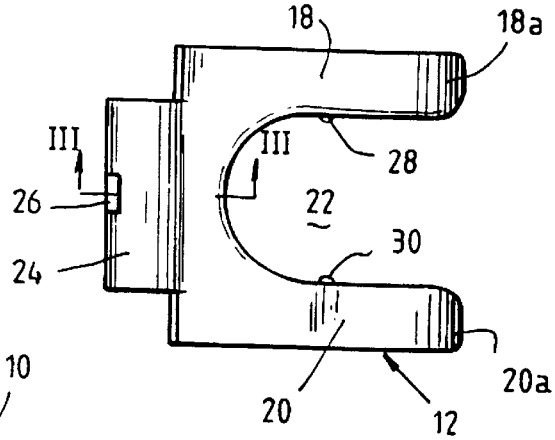
FIG. 2.
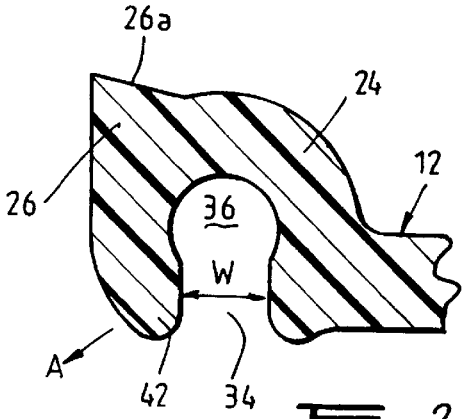
FIG. 3.
FIG. 4.
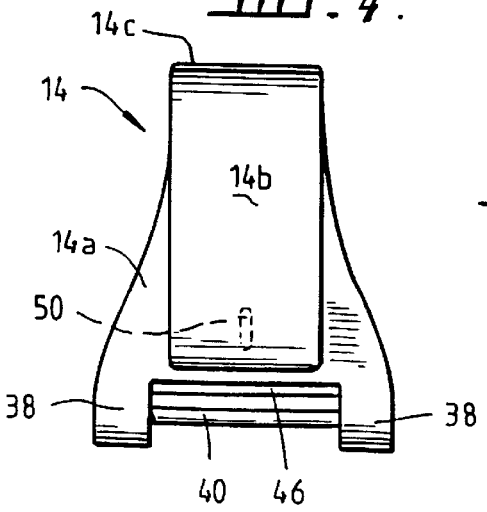
FIG. 5.
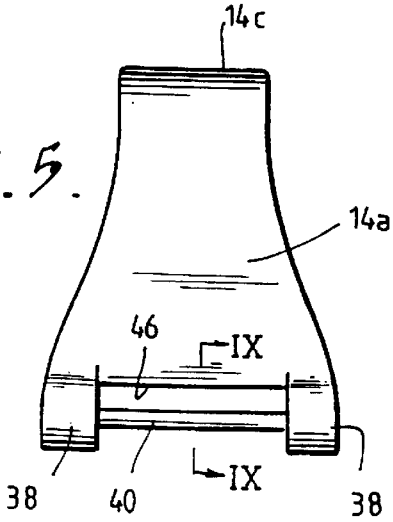

BOTTLE CARRIER

This application is the national phase of international application PCT/AU97/00530 filed Apr. 9, 1999 which designated the U.S.

This invention relates to a bottle carrier and, in particular, but not exclusively, to a bottle carrier which can be suspended from a person's belt or a strap in order to carry a conventional commercial water or other drink bottle.

Supporting devices for enabling a drink bottle to be carried either personally or on a vehicle such as a bicycle are known. However, such carriers intended for personal use generally suffer from the disadvantage from being cumbersome, inconvenient or, alternatively, do not properly support a bottle.

The present invention provides, in a first aspect, a bottle carrier for carrying a bottle having a bottle body, a neck extending upwardly from the bottle body and a flange surrounding the neck, the bottle carrier including:

a connection section for connecting the carrier to an article from which the carrier it to be supported;

a bottle gripping section coupled to the connection section, the bottle gripping section including;

a) a pair of claws, defining a space therebetween, for engaging the flange of the bottle with the space accommodating the neck of the bottle; and b) a downwardly extending end on at least one of the claws of the pair of claws for engaging the bottle body when the neck of the bottle is received in the space so the bottle is retained in the carrier by the combined effect of engagement of the claws with the flange and engagement of the downwardly extending end with the bottle body.

Preferably both of the claws have a downwardly extending end.

Preferably the downwardly extending end is a curved end of each claw.

Preferably the connection section comprises a generally U-shaped strap having a first portion and a second portion, the first and second portions being connected together by a curved transition portion so that the first portion and second portion are arranged adjacent one another.

Preferably one of the first or second portions has a lug for spacing the other of the first or second portions from the said one of the first or second portions.

Preferably the first portion, second portion and transition portion are formed from plastics material and the second portion is biased towards the first portion by the resiliency of the plastic material.

Preferably a pair of locating lugs is provided on the claws and project into the space between the claws.

Preferably a stiffener collar is provided on the claws and surrounds the space.

Preferably the connection section and holding section are pivotally coupled to one another by a pivotal coupling.

Preferably the pivotal coupling includes a boss for limiting pivotal movement of the connection section relative to the bottle gripping section.

Preferably the pivotal connection comprises a pair of spaced apart end sections on one of the gripping section or the connection section and a rod extending between the spaced apart end sections, and a sleeve coupled to the other of the gripping section or connection section, the sleeve having an axially extending slot so that the rod can snap fit into the sleeve through the slot to thereby pivotally couple the sleeve onto the rod to in turn pivotally couple the gripping section to the connection section.

Preferably the boss is provided on the sleeve and limits the amount of pivotal movement of the gripping section relative to the connection section so that the gripping section can move between a folded position wherein the gripping section is substantially parallel with the connection section to a position extending outwardly from the connection section to enable receipt of a bottle.

A second aspect of the invention provides a bottle carrier for carrying a bottle, including:

a connection section for connecting the carrier to an article from which the carrier is to be supported;

a bottle holding section coupled to the connection section for holding the bottle; and pivotal means between the connection section and the bottle holding section for allowing the bottle holding section to pivot relative to the connection section between a folded position substantially parallel to the connection section and a bottle carrying position extending outwardly from the connection section.

Preferably the bottle includes a neck having a flange and a bottle body, the bottle holding section including a pair of claws, defining a space therebetween, for engaging the flange of the bottle with the space accommodating the neck of the bottle, and a downwardly extending end on each of the claws for engaging the body bottle when the neck of the bottle is received in the space so the bottle is retained in the carrier by the combined effect of engagement with the claws with the flange and engagement of the downwardly extending ends with the bottle body.

Preferably the pivot means comprises a sleeve on one of the connection section or bottle holding section, the sleeve having a longitudinal slot, and a rod on the other of the connection section or bottle holding section, the rod being of slightly larger diameter than the slot in the sleeve so that the rod can be forced through the slot in snap-in fashion into the sleeve to thereby retain the rod in the sleeve and with the sleeve pivoting on the rod to thereby pivotally couple the connection section to the bottle holding section.

The invention also provides a bottle carrier for carrying a bottle having a bottle body, a neck extending upwardly from the bottle body and a flange surrounding the neck, the bottle carrier including:

a connection section for connecting the carrier to an article from which the carrier it to be supported;

a bottle gripping section coupled to the connection section, the bottle gripping section including;

a) a pair of claws, defining a space therebetween, for engaging the flange of the bottle with the space accommodating the neck of the bottle; and b) a locating lug on at least one of the claws which projects from the at least one of the claws into the space so that the bottle can be supported on the claws by engagement of the flange with the claws and located between the claws by the neck of the bottle riding over the locating projection and locating behind the locating projection.

The invention also provides a bottle carrier for carrying a bottle having a bottle body, a neck extending upwardly from the bottle body and a flange surrounding the neck, the bottle carrier including:

a connection section for connecting the carrier to an article from which the carrier it to be supported;

a bottle gripping section coupled to the connection section, the bottle gripping section including;

a) a pair of claws, defining a space therebetween, for engaging the flange of the bottle with the space accommodating the neck of the bottle; and b) an upwardly extending end on at least one of the claws of the pair of claws so the bottle is retained in the carrier by the combined effect of engagement of the claws with the flange and the upwardly extending end.

A preferred embodiment of the invention will be described, by way of example, with reference to the accompanying drawings in which:

FIG. 1 is a perspective view of a bottle carrier according to the preferred embodiment;

FIG. 2 is a plan view of a bottle gripping section of the carrier of FIG. 1;

FIG. 3 is an enlarged view along the line III—III of FIG. 2;

FIG. 4 is a rear view of a connection section of the carrier of FIG. 1;

FIG. 5 is a front view of the connection section of FIG. 4;

Figure 6:
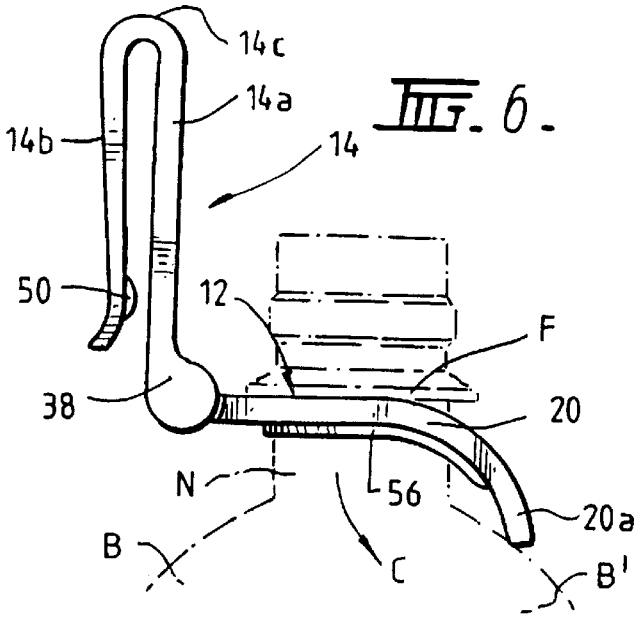
FIG. 6 is a side view of the carrier supporting a bottle.

With reference to FIG. 1, a bottle carrier 10 is shown which has a bottle gripping section 12 pivotally coupled to a connection section 14 by a hinge or pivotal coupling 16. The section 12 includes a pair of claws 18 and 20 which define a generally U-shaped space 22 therebetween. The claws 18 and 20 have curved ends 18*a* and 20*a* respectively which curve downwardly out of the plane of the remainder of the section 12.

Arranged at the end of the section 12 remote from the curved ends 18*a* and 20*a* is a cylindrical sleeve 24. The sleeve 24 carries a generally square-shaped boss 26. As is shown in FIG. 2, the claws 18 and 20 have locating lugs 28 and 30 which project inwardly into the space 22.

Figure 8:
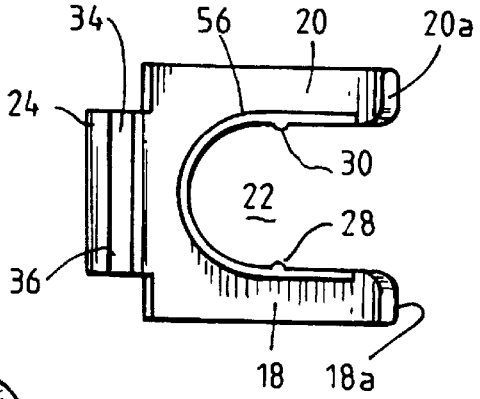
FIG. 8 is an underneath view of the bottle gripping section of the carrier of FIG. 1.

As best shown in FIGS. 3 and 8, the sleeve 24 has a longitudinal slot 34 which extends the entire length of the sleeve 24 and which communicates with interior hollow passage 36 within the sleeve 24.

Connecting section 14 is generally a U-shaped strap having a first portion 14*a* and a second portion 14*b* which are joined by a U-shaped transition portion 14*c*.

As best shown in FIGS. 4 and 5, the connection section 14 has integral cylindrical end portions 38 at its lower extremity. The portions 38 are joined by an integral rod 40.

The rod 40 is of slightly larger diameter than the width W of the slot 34 so that the connecting section 14 can be pivotally coupled to the gripping section 12 by forcing the rod 40 through the slot 34 in snap-in fashion into passage 36. The gripping section 12 and connection section 14 are preferably formed from plastics material so that the lip 42 of the sleeve 24 can flex outwardly generally in the direction of arrow A to enable the rod 40 to pass through the slot 34 and snap into the passage 36. Once the rod 40 is located in the passage 36, the lip 42 can flex back to its original position to hold the rod 40 securely within the passage 36. Thus, the location of the rod 40, through the slot 34 is in the form of a snap-in action so that the connection section 14 can be easily and securely coupled to the gripping section 12 to assemble the carrier 10.

Figure 9:
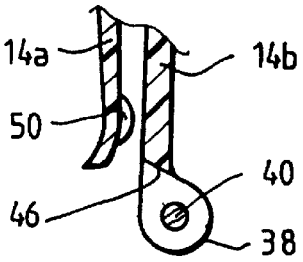
FIG. 9 is a view along the line IX—IX of FIG. 5.

As is best shown in FIG. 9, the intermediate edge 46 of the connection section 14 between the end portions 38 is inclined and provides an abutment for the boss 26 to limit pivotal movement of the connection section 14 relative to the gripping section 12.

Figure 7:
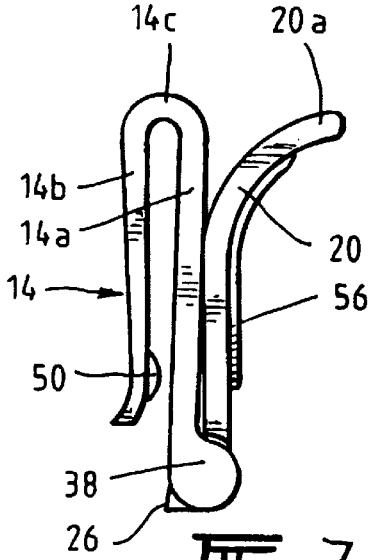
FIG. 7 is a side view of the carrier in a folded closed position.

In order to pivotally couple the connection section 14 and gripping section 12, the rod 40 is located in the passage 36 as previously described with the sections 12 and 14 generally being oriented at an angle of 180° with respect to one another so that the rod 40 can easily enter the slot 34 and passage 36. The sections 12 and 14 are then pivoted relative to one another to move the sections 12 and 14 into the position shown in FIGS. 6 and 7. As the sections reach an angle of 90° with respect to one another, the boss 26 will ride over the edge 46 with a clip type action. The sections 12 and 14 can then be pivotally moved relative to one another into a completely closed position as shown in FIG. 7 for storage or transportation when a bottle is not carried by the carrier 10. The boss 26 will limit the pivotal movement of the sections 12 and 14 relative to one another to an angle of approximately 90° back to the position shown in FIG. 6 where the surface 46 will contact inclined surface 26*a* of the boss 26 so that the surface 26*a* acts as a stop to limit the amount of relative rotation between the sections 12 and 14.

If it is desired to disassemble the sections 12 and 14, the section 14 can be rotated past the stop formed by the boss 26 by forcing the surface 46 over the boss 26 so that the sections 12 and 14 can take up an angle of approximately 180° and by twisting the sections 12 and 14 relative to one another, the rod 40 can be removed from the passage 36 to separate the sections 12 and 14.

As is shown in FIG. 8, a stiffening collar 46 extends about the periphery of the space 22 on the lower side of the claws 18 and 20 so as to stiffen the claws 18 and 20 and reduce the amount of twisting or flexing movement of the claws 20 and 18 relative to one another.

After the sections 12 and 14 are assembled as described above, a bottle B shown in FIG. 6 can be carried by the carrier 10 by locating neck N of the bottle in the space 22. The neck N is inserted into the space 22 until the neck N passes the locating projections 30 and 28 in snap-in fashion. The neck N has a flange F which is arranged above the claws 18 and 20 so that the flange F is supported on the claws 18 and 20. The bottle B therefore hangs suspended between the claws 18 and 20 with the flange F resting on the claws 18 and 20.

The connection section 14 can be connected to a belt, waistband or strap by locating the belt, waistband or strap between the portions 14*a* and 14*b* and therefore the carrier 10 can be suspended from a person's belt or waistband, or located on the strap which can be carried over a person's shoulder. When the bottle B is located between the claws 18 and 20, and the connection section 14 is suspended from a belt or the like, the weight of the bottle will tend to pivot the carrier 10 into an inclined position as shown in FIG. 6 due to the carrier 10 being supported generally at the transition portion 14*c* on the belt, waistband or strap until the centre of gravity of the bottle is below the portion 14*c* or the carrier 10 abuts tightly against a person's hip or waist thereby limiting further movement. Once the carrier 10 is stabilised in position, the weight of the bottle 10 will again attempt to locate the bottle in an upright position with its centre of gravity at its lowest point and this will have the tendency of pivoting the bottle B in the direction of arrow C in FIG. 6 relative to the carrier 10. This will bring the body portion B' of the bottle against the curved ends 20*a* and 18*a* of the claws 20 and 18 thereby securely retaining the bottle B within the carrier 10 by the combined action of the engagement of the flange F on the claws 18 and 20 and engagement of the curved ends 20*a* and 18*a* against the body B' of the bottle.

The locating projections 28 and 30 do not play any significant role in securing the bottle within the carrier 10, but rather serve as a guide to ensure that a user by feel can ensure that the neck N of the bottle B is inserted correctly into the space 22 between the claws 18 and 20 so that the claws 18 and 20 will be positioned relative to the bottle B in an optimum position (as shown in FIG. 6) so that the bottle can be properly and securely supported within the carrier 10.

Preferably the portion 14*b* of the connecting section 14 has a small centrally located web 50 which serves the dual purpose of assisting in secure location of the belt or strap in the space between the portions 14*a* and 14*b* and also serves to position the portion 14*b* away from the portion 14*a* after moulding of the section 14 to ensure that the section 14*a* and 14*b* do not contact and stick together as the moulded connection section 14 cools.

It should be noted that in FIGS. 6 and 7, the portion 14*a* and 14*b* are shown slightly flexed apart. In actual use, the web 50 would rest against the portion 14*a* and the resilient nature of the plastics material from which the connection section 14 is formed will ensure that the portion 14*b* is biased by that resiliency towards the portion 14*a*.

Although, in the preferred embodiment of the invention, the section 12 has curved ends 20*a* and 20*b*, the invention could be embodied without curved ends 18*a* and 20*a* and merely rely on engagement between the claws 18 and 20 and the flange F to secure the bottle in place. Alternatively, if desired, the section 12 could be inverted with respect to the position shown in the drawings so that the curved ends 20*a* and 20*b* curve upwardly rather than downwardly as shown.

Figure 10:
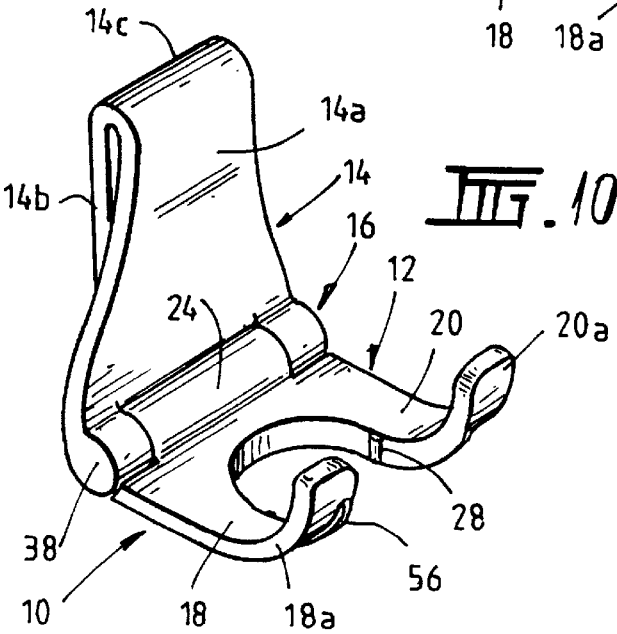
FIG. 10 is a view of a second embodiment of the invention.
Figure 11:
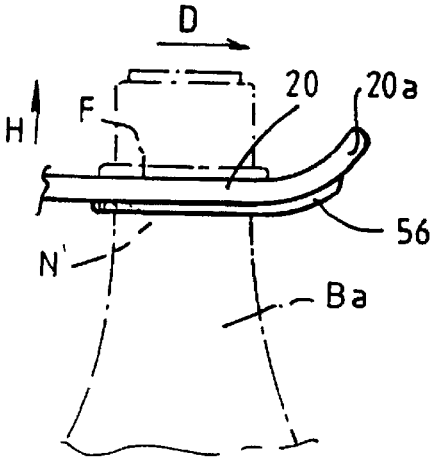
FIG. 11 is a view of a bottle being supported in the embodiment of FIG. 10.

FIGS. 10 and 11 show an embodiment of the invention in which the claws 18 and 20 have ends 18*a* and 20*a* which are turned upwardly rather than downwardly as per the previous embodiment. Indeed, in the embodiment of FIGS. 10 and 11, the carrier 10 is formed precisely in the same manner as previously described except that the ends 18*a* and 20*a* curve upwardly.

The embodiment of FIGS. 10 and 11 has particular application to a bottle Ba (see FIG. 11) which has a generally long slender neck. Indeed, in this embodiment of the invention, the claws 18 and 20 could be straight without curved ends which project either upwardly or downwardly but this embodiment of the invention preferably utilises the upwardly curved ends 18*a* and 20*a* to provide assistance in retaining the bottle Ba in the carrier 10 as will be described hereinunder.

In the embodiment of FIGS. 10 and 11, the locating lugs 28 play more of a retaining role than in the previous embodiment to locate the neck N' of the bottle Ba securely between the claws 18 and 20 with flange F' resting on the claws 18 and 20. Location of the neck N' behind the lugs 28*a* resists movement of the bottle Ba in the direction of arrow D in FIG. 11. Obviously, when it is desired to remove the bottle Ba from the carrier 10, sufficient force applied in the direction of arrow D will cause the neck N' to ride over the lugs 28 so the bottle can be removed. In this embodiment, although the curved ends 18*a* and 20*a* need not be provided and the claws 18 and 20 could be straight, the curved ends 18*a* and 20*a* also assist in unwanted separation of the bottle Ba from the carrier 10 because if the bottle Ba is accidentally forced past the lugs 28, it is necessary for the bottle to move upwardly in the direction of arrow H in FIG. 11 until the flange F' is above the end of the curved sections 18*a* and 20*a* before the bottle can completely separate from the carrier 10. Thus, whilst the upwardly curved ends 18*a* and 20*a* in the embodiment of FIGS. 10 and 11 do not actually contact the body to retain the body within the carrier 10 they nevertheless assist in accidental separation of the bottle Ba from the carrier 10 in view of the need to lift the bottle Ba upwardly relative to the claws 18 and 20 so that the flange F' can clear the ends of the upwardly curved ends 18*a* and 20*a* before the bottle Ba will separate from the carrier 10.

Long necked bottles Ba may be able to be properly supported in a carrier 10 in the orientation of FIG. 1 if the carrier 10 is supported on a strap more so than if the carrier 10 is located on a belt or waistband. If it is desired to carry bottles Ba by locating the carrier 10 on a belt or waistband, the orientation shown in FIGS. 10 and 11 may be more desirable.

The connection section 12 shown in FIG. 10 would also include a boss (not shown) similar to the boss 26 to limit the amount of pivotal movement of the section 12 relative to the section 14 to approximately 90° so that the carrier takes up the orientation shown in FIG. 10 when unfolded. The boss, as is the case in the embodiment of FIG. 1, holds the gripping section 12 at approximately 90° with respect to the connection section and prevents the gripping section 12 from opening further relative to the connection section under the weight of a bottle when a bottle is held by the gripping section.

In other embodiments of the invention, it would be possible to design the position of the boss 26 and the slot 34 so that a single connection section 12 could be connected at manufacture either with the ends 18*a* and 20*a* curved upwardly or by inverting the position of the gripping section 12 with the ends 18*a* and 20*a* curved downwardly. Thus, a single gripping section 12 could be made which could be located in either of the orientations at manufacture as is required. The position of the slot 34 and boss 26 would need to ensure that regardless of which orientation is selected, the gripping section 12 will be held at approximately the 90° configuration shown in FIGS. 1 and 11 when the carrier is opened to receive a bottle.

The hinge formed by the pivotal connection of the sections 12 and 14 enable the carrier to be folded into a closed position shown in FIG. 7 for easy transportation or storage and to be readily opened for carriage of a bottle B when required.

The distance between the claws 18 and 20 is obviously such that to receive the neck N of a bottle but less than the distance of the outermost diameter of the flange F so that the flange F will locate on the claws 18 and 20 and not merely fall between the claws 18 and 20. The carrier 10 is preferably dimensioned so as to receive a standard 25 mm bottleneck, but if desired different spacings could be provided to suit bottleneck sizes of any particular dimension which may be required to be carried by the carrier 10.

Whilst the preferred embodiment of the invention has been described with reference to a bottle B which has a flange F, it should be understood that any relatively large diameter portion on the neck of a bottle will allow the bottle to be used with the carrier 10 of the preferred embodiment of the invention. Indeed, even the location of a screw-thread cap on the neck of a bottle can provide an enlarged diameter portion relative to the neck of the bottle which can be supported on the claws 18 and 20 thereby enabling the bottle to be carried in the carrier 10. Thus, it should be understood that the reference to a flange F in this specification is merely a reference to a relatively enlarged diameter portion of the neck of a bottle which will enable the bottle to be supported by the claws 18 and 20 when the neck of the bottle is received between the claws 18 and 20.

In the preferred embodiment of the invention, the carrier 10 is formed from plastics material with the connection section 14 and the gripping section 12 being separately moulded and joined together as previously described. However, in other embodiments, the carrier 10 could be formed from other materials including metal.

Since modifications within the spirit and scope of the invention may readily be effected by persons skilled within the art, it is to be understood that this invention is not limited to the particular embodiments described by way of example hereinabove.

The claims defining the invention are as follows:

1. A bottle carrier for carrying a bottle having a bottle body, a neck extending upwardly from the bottle body and a flange surrounding the neck, the bottle carrier including:

a connection section for connecting the carrier to an article from which the carrier is to be supported;

a bottle gripping section coupled to the connection section, the bottle gripping section including;

a) a pair of claws, defining a space therebetween, for engaging the flange of the bottle with the space accommodating the neck of the bottle; and b) a downwardly extending end on at least one of the claws of the pair of claws for engaging the bottle body when the neck of the bottle is received in the space so the bottle is retained in the carrier by the combined effect of engagement of the claws with the flange and engagement of the downwardly extending end with the bottle body.

2. The carrier of claim 1, wherein both of the claws have a downwardly extending end.

3. The carrier of claim 2, wherein the downwardly extending end is a curved end of each claw.

4. The carrier of claim 1, wherein the connection section comprises a generally U-shaped strap having a first portion and a second portion, the first and second portions being connected together by a curved transition portion so that the first portion and second portion are arranged adjacent one another.

5. The carrier of claim 4, wherein one of the first or second portions has a lug for spacing the other of the first or second portions from the said one of the first or second portions.

6. The carrier of claim 4, wherein the first portion, second portion and transition portion are formed from plastic material and the second portion is biased towards the first portion by the resiliency of the plastic material.

7. The carrier of claim 1, wherein a pair of locating lugs is provided on the claws and project into the space between the claws.

8. The carrier of claim 1, wherein a stiffener collar is provided on the claws and surrounds the space.

9. The carrier of claim 1, wherein the connection section and gripping section are pivotally coupled to one another by a pivotal coupling.

10. The carrier of claim 9, wherein the pivotal coupling includes a boss for limiting pivotal movement of the connection section relative to the bottle gripping section.

11. The carrier of claim 9, wherein the pivotal connection comprises a pair of spaced apart end sections on one of the gripping section or the connection section and a rod extending between the spaced apart end sections, and a sleeve coupled to the other of the gripping section or connection section, the sleeve having an axially extending slot so that the rod can snap fit into the sleeve through the slot to thereby pivotally couple the sleeve onto the rod to in turn pivotally couple the gripping section to the connection section.

12. The carrier according to claim 11, wherein the boss is provided on the sleeve and limits the amount of pivotal movement of the gripping section relative to the connection section so that the gripping section can move between a folded position wherein the gripping section is substantially parallel with the connection section to a position extending outwardly from the connection section to enable receipt of a bottle.

13. A bottle carrier for carrying a bottle including:

a connection section for connecting the carrier to an article from which the carrier is to be supported;

a bottle holding section coupled to the connection section for holding the bottle; and pivotal means between the connection section and the bottle holding, section for allowing the bottle holding section to pivot relative to the connection section between a folded position substantially parallel to the connection section and a bottle carrying position extending outwardly from the connection section, wherein the bottle includes a neck having a flange and a bottle body, the bottle holding section including a pair of claws, defining a space therebetween, for engaging the flange of the bottle with the space accommodating the neck of the bottle, and a downwardly extending end on each of the claws for engaging the bottle body when the neck of the bottle is received in the space so the bottle is retained in the carrier by the combined effect of engagement of the claws with the flange and engagement of the downwardly extending ends with the bottle body.

14. A bottle carrier for carrying a bottle, including:

a connection section for connecting the carrier to an article from which the carrier is to be supported;

a bottle holding section coupled to the connection section for holding the bottle; and pivotal means between the connection section and the bottle holding section for allowing the bottle holding section to pivot relative to the connection section between a folded position substantially parallel to the connection section and a bottle carrying position extending outwardly from the connection section, wherein the pivot means comprises a sleeve on one of the connection section or bottle holding section, the sleeve having a longitudinal slot, and a rod on the other of the connection section or bottle holding section, the rod being of slightly larger diameter than the slot in the sleeve so that the rod can be forced through the slot in snap-in fashion into the sleeve to thereby retain the rod in the sleeve and with the sleeve pivoting on the rod to thereby pivotally couple the connection section to the bottle holding section.

15. A bottle carrier for carrying a bottle having a bottle body, a neck extending upwardly from the bottle body and a flange surrounding the neck, the bottle carrier including:

a connection section for connecting the carrier to an article from which the carrier it to be supported;

a bottle gripping section coupled to the connection section, the bottle gripping section including;

a) a pair of claws, defining a space therebetween, for engaging the flange of the bottle with the space accommodating the neck of the bottle; and b) a locating lug on at least one of the claws which projects from the at least one of the claws into the space so that the bottle can be supported on the claws by engagement of the flange with the claws and located between the claws by the neck of the bottle riding over the locating projection and locating behind the locating projection.

16. The carrier of claim 15, wherein both of the claws have an upwardly or downwardly extending end.

17. The carrier of claim 15, wherein each claw has a locating lug which projects into the space between the claws.

18. The carrier of claim 15, wherein a stiffener collar is provided on the claws and surrounds the space.

19. The carrier of claim 15, wherein the connection section and gripping section are pivotally coupled to one another by a pivotal coupling.

20. The carrier of claim 15, wherein the pivotal coupling includes a boss for limiting pivotal movement of the connection section relative to the bottle gripping section.

21. The carrier of claim 19, wherein the pivotal connection comprises a pair of spaced apart end sections on one of the gripping section or the connection section and a rod extending between the spaced apart end sections, and a sleeve coupled to the other of the gripping section or connection section, the sleeve having an axially extending slot so that the rod can snap fit into the sleeve through the slot to thereby pivotally couple the sleeve onto the rod to in turn pivotally couple the gripping section to the connection section.

22. A bottle carrier for carrying a bottle having a bottle body, a neck extending upwardly from the bottle body and a flange surrounding the neck, the bottle carrier including:

a connection section for connecting the carrier to an article from which the carrier it to be supported;

a bottle gripping section coupled to the connection section, the bottle gripping section including;

a) a pair of claws, defining a space therebetween, for engaging the flange of the bottle with the space accommodating the neck of the bottle; and b) an upwardly extending end on at least one of the claws of the pair of claws so the bottle is retained in the carrier by the combined effect of engagement of the claws with the flange and the upwardly extending end.

23. The carrier of claim 22, wherein both of the claws have an upwardly extending end.

24. The carrier of claim 23, wherein the upwardly extending end is a curved end of each claw.

25. The carrier of claim 22 wherein a pair of locating lugs is provided on the claws and project into the space between the claws.

26. The carrier of claim 22, wherein a stiffener collar is provided on the claws and surrounds the space.

27. The carrier of claim 22, wherein the connection section and gripping section are pivotally coupled to one another by a pivotal coupling.

28. The carrier of claim 27, wherein the pivotal coupling includes a boss for limiting pivotal movement of the connection section relative to the bottle gripping section.

29. The carrier of claim 27, wherein the pivotal connection comprises a pair of spaced apart end sections on one of the gripping section or the connection section and a rod extending between the spaced apart end sections, and a sleeve coupled to the other of the gripping section or connection section, the sleeve having an axially extending slot so that the rod can snap fit into the sleeve through the slot to thereby pivotally couple the sleeve onto the rod to in turn pivotally couple the gripping section to the connection section.

* * * * *